US005277371A

United States Patent [19]

Bowns et al.

[11] Patent Number: 5,277,371

[45] Date of Patent: Jan. 11, 1994

[54] MULTI PIN ROTOR FIBER FLUFF GENERATOR

[75] Inventors: Mark W. Bowns, Auburn; Herrman J. Maag, Yelm, both of Wash.

[73] Assignee: Weyerhaeuser Company, Tacoma, Wash.

[21] Appl. No.: 607,157

[22] Filed: Oct. 31, 1990

[51] Int. Cl.[5] ..... B02C 13/22

[52] U.S. Cl. ..... 241/154; 241/190; 241/243; 241/605

[58] Field of Search ..... 241/190, 187, 154, 236, 241/243, 605

[56] References Cited

U.S. PATENT DOCUMENTS

| | | | |
|---|---|---|---|
| 246,992 | 9/1881 | Anderson | 241/187 X |
| 345,408 | 7/1886 | Birge | 241/187 X |
| 3,696,817 | 10/1972 | Bonner, Jr. et al. | 241/154 X |
| 3,863,850 | 2/1975 | Freeman | 241/236 X |
| 4,265,151 | 5/1981 | Carruth et al. | 241/187 X |
| 4,533,507 | 8/1985 | Tao | 261/153 |
| 4,572,440 | 2/1986 | Tao | 241/23 |

FOREIGN PATENT DOCUMENTS

| | | |
|---|---|---|
| 0399564 | 5/1990 | European Pat. Off. . |
| 1256803 | 9/1986 | U.S.S.R. . |

OTHER PUBLICATIONS

American Society of Agricultural Engineers, ASAE publication Oct. 1981, *Forest Regeneration,* 108–117, (Mar. 1981).

*Primary Examiner*—Mark Rosenbaum
*Assistant Examiner*—Frances Chin
*Attorney, Agent, or Firm*—Klarquist, Sparkman, Campbell, Leigh & Whinston

[57] ABSTRACT

A fiber fluff generator includes a housing having three substantially cylindrical portions, each of which mounts and contains a rotor having a rotor shaft and a plurality of rotor pins extending radially therefrom. The rotor pins are arranged in rows spaced incrementally along the length of the shaft with gaps therebetween, each row including plural rotor pins arranged in spoke-like fashion. The rotor shafts preferably are mounted parallel to one another and lie in a common vertical plane. The rotor pins on one rotor shaft are axially offset from and overlap with the rotor pins on the adjacent rotor shaft(s) so that the rotor pins collectively are interleaved to provide a cross-combing effect. Stator pins fastened to the housing extend radially inwardly into the gaps between the rows of rotor pins to provide further cross-combing interaction. As the rotors rotate, fiber introduced into an inlet at the top of the housing flows downwardly toward an outlet located at the bottom of the housing while it is fluffed and combed by the three-stage rotor arrangement.

15 Claims, 3 Drawing Sheets

Fig. 4
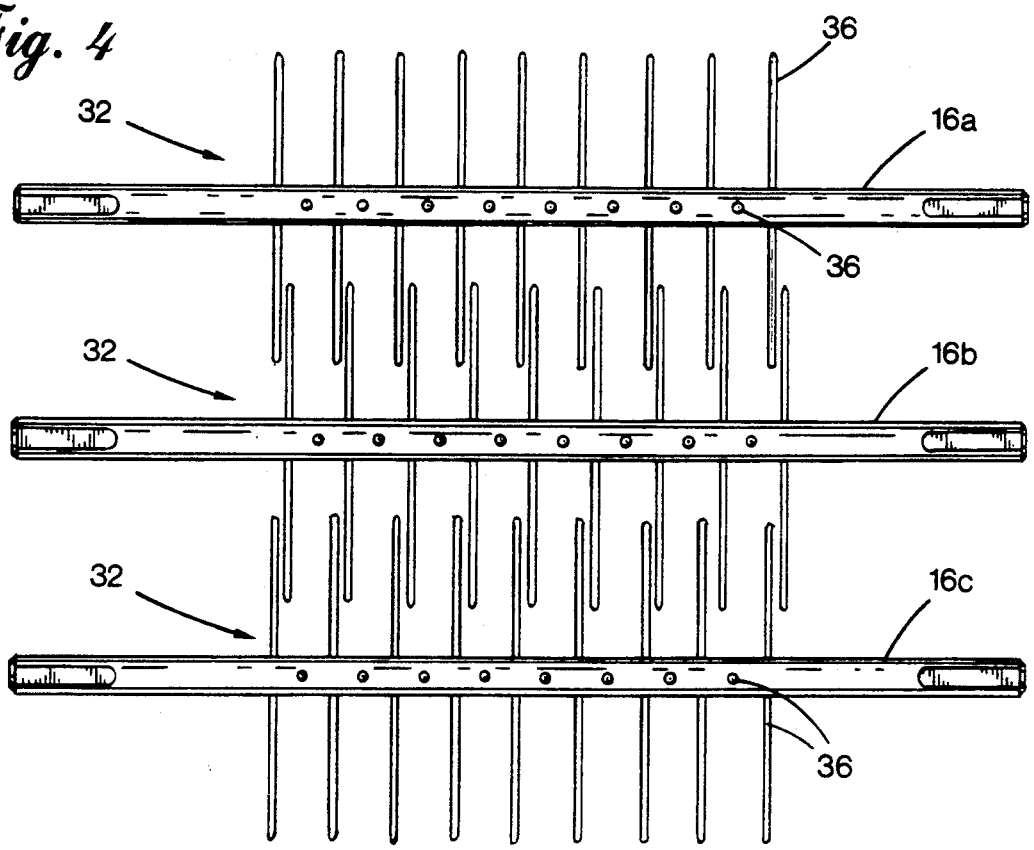
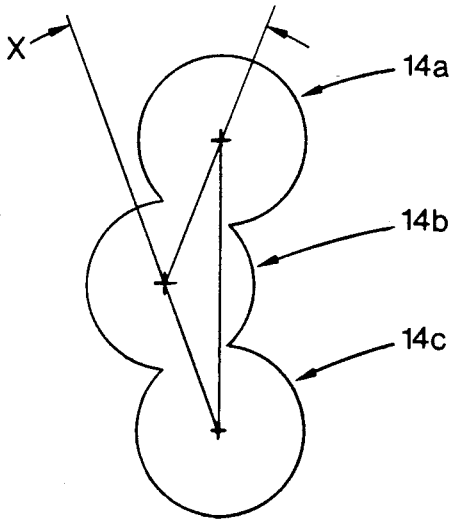
Fig. 5

MULTI PIN ROTOR FIBER FLUFF GENERATOR

TECHNICAL FIELD

This invention relates to cellulose fiber fluff generators and more particularly to fluff generators which are capable of large volume continuous flow operations.

BACKGROUND OF THE ART

Fiber fluff generators commonly used in the pulp and paper industry typically employ a rotor having a rotating shaft with rotor pins extending radially therefrom. The rotor is enclosed in a cylindrical housing and is driven by a motor. Such generators have less capacity than is desirable and do not generally fluff the fiber material as thoroughly as is desirable. Current fluff generators also have interiors which are relatively difficult to access for inspection, maintenance and cleaning.

SUMMARY OF INVENTION

It is an object of the present invention to provide an apparatus for fluffing cellulose fibers in a thorough and effective manner.

A further object of the present invention is to provide a fluffer which has the capacity to process quickly large quantities of cellulose fiber.

It is yet another object of the invention to provide an apparatus with means for easy access to the interior of the fluffer for cleaning and maintenance.

Other objects and advantages of the invention will be apparent from the drawings and following detailed description.

The invention achieves these and other objects by providing an apparatus for fluffing cellulose fiber which includes plural adjacently positioned rotors, each having pins extending radially therefrom. The rotors rotate about respective rotor shaft axes which are parallel to one another. When rotated, the rotor pins sweep out rotor pin paths having gaps therebetween. Each rotor pin is positioned along its respective rotor shaft axis to align with a corresponding rotor pin path gap of the adjacent rotor(s). Each rotor shaft is spaced from the adjacent rotor shaft(s) by a distance less than double the length of the rotor pins, such that the rotor pins of one rotor overlap and interdigitate with the rotor pins of adjacent rotor(s) to provide a cross-combing function. A housing is provided to contain the rotors and permit their free rotation therein. The housing has an interior surface separated from the distal ends of the rotor pins by a clearance gap. Mounted to such interior surface are a plurality of inwardly pointing stator pins which are longer than the clearance gap so as to overlap the rotor pins. Each stator pin is positioned to reside within one of the gaps between the rotor pin paths of the adjacent rotor. The housing preferably is comprised of first and second separable housing components to permit the housing to be split in half for easy maintenance access.

BRIEF DESCRIPTION OF THE DRAWINGS

FIG. 4 is an internal schematic view of a rotor portion of the invention;

FIG. 5 is a schematic view of an alternate embodiment of the invention.

DETAILED DESCRIPTION OF A PREFERRED EMBODIMENT

Figure 1:
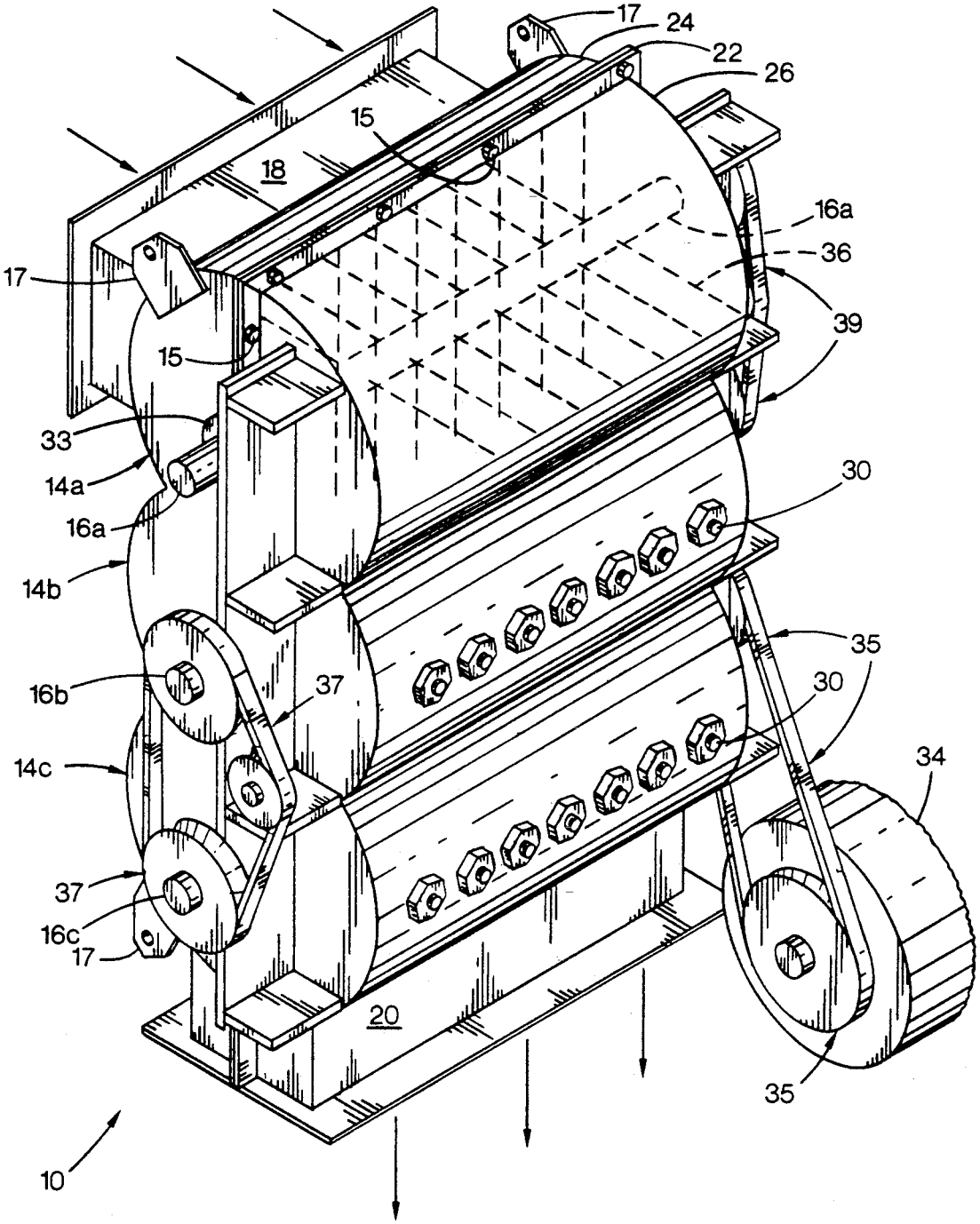
FIG. 1 is an isometric view of an apparatus embodying the present invention.
Figure 3:
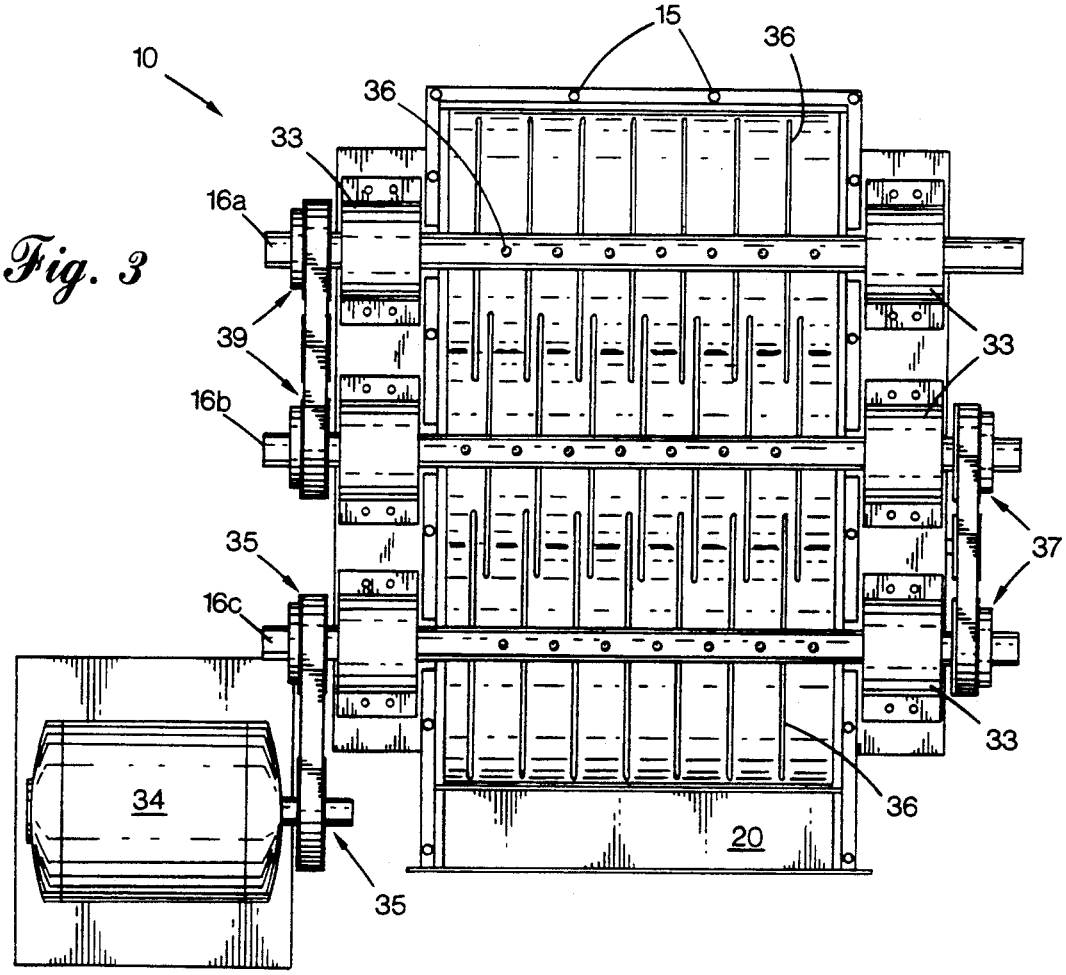
FIG. 3 is a vertical sectional view of the invention.

Referring to the drawings, FIG. 1 illustrates a fluff generator 10 constructed in accordance with the present invention. The invention includes a housing comprised of a plurality of integrally connected, substantially cylindrical portions 14*a*, 14*b*, 14*c*, each having respective parallel longitudinal axes of equal length, whereby the ends of the cylindrical portions are coplanar. Cylindrical portion 14*a* opens into cylindrical portion 14*b* which, in turn, opens into cylindrical portion 14*c*, thereby forming a contiguous arrangement of partially intersecting cylinders. The housing includes two separable housing components, a first housing section 24 and a second housing section 26, which are joined together at a sealed seam 22. Seam 22 substantially bifurcates the housing. Sections 24, 26 are fastened together at peripheral flange portions thereof by suitable fastening means such as bolts 15 (FIG. 3). Sections 24, 26 may be separated using integrally connected lugs 17 to facilitate access to the interior of the housing for maintenance and inspection.

Figure 2:
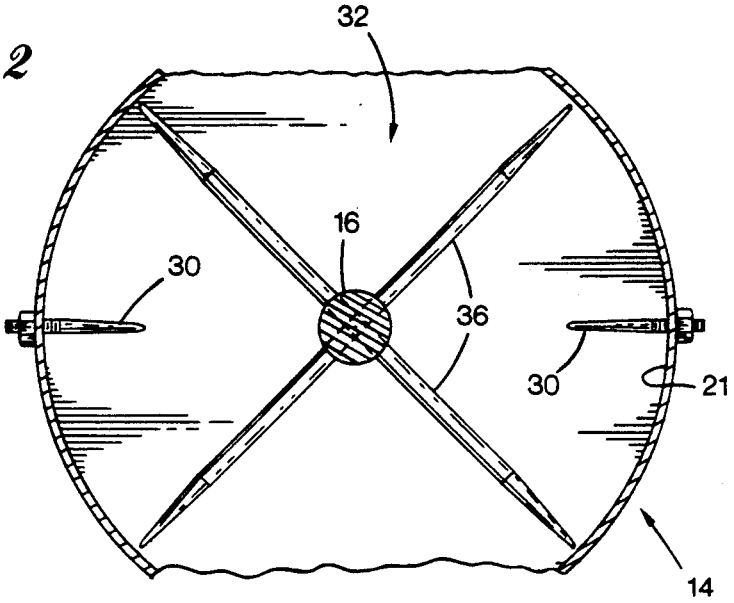
FIG. 2 is a sectional end view or one of the rotors of the present invention.

The housing is provided with an inlet portion 18 which delivers pulp fibers to distal cylindrical portion 14*a* and an outlet portion 20 which receives fluffed pulp fibers from distal cylindrical portion 14*c* following their sequential passage through cylindrical portion 14*a*, portion 14*b* and finally portion 14*c*. In addition, as shown in FIG. 2, the housing has an interior surface 21 from which projects a plurality of radially inwardly pointing stator pins 30. Each stator pin has a threaded end portion extending through the exterior wall of one of the cylindrical portions 14*a*, 14*b*, or 14*c*, which receives a nut to removably fasten the stator pin to the housing. The radial orientation of the stator pins is with reference to the longitudinal center axis of the cylindrical portion to which the stator pin is fastened.

The housing is sized and shaped to contain three interleaved rotors 32, one within each cylindrical portion of the housing, in a sealed environment. Each rotor 32 includes a rotatable rotor shaft 16*a*, 16*b*, or 16*c* having an axis of rotation coextensive with the longitudinal axis of its respective cylindrical portion, such that the rotor is positioned coaxially within the cylindrical portion. Each rotor shaft is rotatably supported at each end thereof by a pillow block bearing 33 (FIG. 3) supported by one of the cylindrical portion end walls. Thus, as FIGS. 1, 3 and 4 illustrate, rotor shafts 16*a*, 16*b*, 16*c* are mounted parallel to one another, with the two outermost shafts 16*a*, 16*c* being spaced an equal distance from central rotor shaft 16*b*.

Although the preferred embodiment is shown having three rotors, it will be appreciated that the number of rotors is variable depending upon the desired retention time of the fibers in the fluffer.

Referring to FIGS. 1 and 3, all three rotor shafts are linked to a common drive arrangement and rotatably driven in the same direction by a drive means, such as an electric motor 34. More specifically, motor 34 drives a proximate end of shaft 16*c* through a conventional sheave and belt arrangement 35. The opposite distal end of shaft 16*c* similarly is linked to shaft 16*b* by a sheave and belt arrangement 37. In turn, the opposite end of shaft 16*b* is linked to shaft 16*a* by a sheave and belt arrangement 39. This drive arrangement enables the rotors to be rotated synchronously at the same angular velocity. Alternatively, the rotors could be driven separately at different angular velocities, if desired, by using separate drive means.

Each rotor is provided with a plurality of rotor pins 36 extending radially outward from the rotor shaft a distance proximate to the interior surface of the housing. In the preferred embodiment, two opposed rotor pins are formed from a single pin element which is inserted through an opening in the rotor shaft and welded to the shaft at its midpoint. Alternatively, each rotor pin may be attached individually to the rotor shaft by welding or by screwing a threaded end portion thereof into a corresponding threaded opening in the rotor shaft. The "clearance" gap or distance between the ends of the rotor pins and the interior surface of the housing is preferably within the range of about 1/16 to 1 inch, and optimally about ¼ inch.

In the preferred embodiment, the rotor pins on each rotor shaft are arranged in plural groups or sets which are spaced along the length of the shaft. Each set preferably includes two rotor pins angularly spaced at an angle of 180 degrees from each other about the rotor shaft. Each set of two rotor pins is angularly displaced 90 degrees relative to the adjacent sets on either side, thereby forming an alternating pattern in which every other set of rotor pins occupies, for example, the 6 o'clock and 12 o'clock positions, while the sets therebetween occupy the 3 o'clock and 9 o'clock positions.

A corresponding set or group of two stator pins 30 (FIG. 2) extends radially inwardly into each gap formed between adjacent sets of rotor pins. The length of the rotor pins and stator pins is such that they overlap radially to provide an interdigitated or interleaved relationship. In other words, the stator pins are substantially longer than the distance or clearance gap between the ends of the rotor pins and the interior surface of the housing.

The rotor pins and stator pins are spaced incrementally such that a gap exists between each set of rotor and stator pins. The gap preferably is within the range of about 1/16 to 1 inch, and optimally about ¼ inch. The rotor pins and stator pins may be tapered to a point for better combing action.

Similarly, the distance between adjacent rotor shafts is less than double the length of the rotor pins, such that the rotor pins of adjacent rotors substantially overlap one another to provide an interdigitated or interleaved relationship. Stated differently, the rotor pins of one rotor are aligned with and project into the rotor pin gaps of the adjacent rotor(s). No interference exists between adjacent rotors because the rows of rotor pins on one rotor shaft are axially offset from the rows of rotor pins on the adjacent rotor shaft(s), thereby providing the interleaved relationship.

An alternate embodiment of the invention is shown in FIG. 5. In this embodiment, the rotors are not fully aligned. In the illustrated example, one of the rotors can be offset from the other two by an angle "x" ranging from 0 to 90 degrees.

The components within the housing, such as the rotor pins, preferably are case hardened to prolong their useful life.

In operation, the fluff generator is operated by driving the rotors at a high rotational tip speed, typically about 1750 RPM, while feeding airborne cellulose fibers into the housing through inlet 18. Once the fibers enter the housing, the housing's upright relationship will cause the fibers to flow generally downwardly by gravity or air flow toward outlet 20. The fiber is processed to minimize nits and twists in the fibers through close interaction of the rotor pins with the stator pins, as well interaction of rotor pins of adjacent rotors. Such interaction occurs as the overlapping rotor pins pass closely by one another in opposite directions and as the rotor pins pass closely by the stationary stator pins. In this way, the fiber is subjected to a cross-combing action which opens up and separates the pulp or cellulose fiber bundles and thereby prepares the pulp fibers for further processing. Typically, the fluffed fibers then are conveyed from the fluff generator to a flash dryer.

It will be appreciated that the cross-combing effect produced by the three-stage rotor arrangement is caused by the rotor pins of one shaft moving in an opposite direction to the rotor pins of the adjacent rotor(s) as they pass closely by one another. A similar cross-combing effect occurs when the rotor pins pass in close overlapping relationship to the stationary stator pins. Thus, the pulp fibers are subjected to a highly efficient and rigorous combing and fluffing action within a relatively short distance of travel, thereby fluffing and separating the fibers and straightening out twists.

As an additional advantage, the housing can be easily split in half to provide easy access to the interior thereof for inspection, maintenance or cleaning.

The use of an inlet and outlet extending the full width of the generator, as shown, is preferable because it allow for high volumes of fibers in sheet-like form to be more easily processed.

It will be appreciated that while the use of three rotors is preferred, the principles of the present invention can be applied to generators having one to four or more rotors. Also, different numbers of stator pins and rotor pins can be used and still achieve the benefits of the present invention.

Having illustrated and described the principles of our invention by what is presently a preferred embodiment, it should be apparent to those persons skilled in the art that the illustrated embodiment may be modified without departing from such principles. I claim as my invention not only the illustrated embodiment but all such modifications, variations, and equivalents thereof as come within the true spirit and scope of the following claims.

I claim:

1. A fluff generator to eliminate nits and twists from the pulp fibers and to provide an output of generally separate fibers, the fluff generator comprising:

a plurality of adjacently positioned rotors, each comprising a rotating shaft having a plurality of rotor pins extending radially therefrom along substantially the entire length of each shaft, the rotors all rotating in the same direction about respective rotor shaft axes, the rotor pins sweeping out rotor pin paths having gaps therebetween, each rotor pin being positioned to align with the rotor pin path gaps of adjacent rotors, the rotating shafts being parallel to each other, each shaft being separated from adjacent shafts by a distance substantially less than double the length of the rotor pins, whereby the rotor pins overlap and are interdigitated with the rotor pins of adjacent rotors, providing a cross-combing function;

a housing sized and shaped to contain the rotors and permit their free rotation therein, the housing having an interior surface separated from the distal ends of the rotor pins by a clearance gap, the interior surface of the housing being provided with a plurality of radially and inwardly pointing stator pins, the stator pins being substantially longer than the clearance gap, and each stator pin being positioned to reside within a gap between rotor pin paths of the adjacent rotor, the housing having an inlet for receiving pulp fibers and an outlet through which the pulp fibers are delivered from the housing following passage across the rotors, and drive means for rotating the rotors.

2. The fluff generator of claim 1 including up to four rotors.

3. The fluff generator of claim 1 wherein at least one of the rotors has its rotor shaft axis offset from a plane containing the rotor shaft axes of at least two other rotors.

4. The fluff generator of claim 1 wherein each rotor pin extends radially outwardly from the rotor axis in a direction which is offset about ninety degrees about the rotor axis from adjacent pins.

5. The fluff generator of claim 1 wherein the housing comprises first and second separable housing components, the housing components may be separated to provide access to the interior of the housing for maintenance.

6. The fluff generator of claim 1 wherein the clearance gap does not exceed about one-fourth of an inch.

7. A fluff generator to eliminate nits and twists from pulp fibers and to provide an output of generally separate fibers, the fluff generator comprising:

a plurality of adjacently positioned rotors, each comprising a rotating shaft having a plurality of rotor pins extending radially therefrom, the rotors all rotating in the same direction about respective rotor shaft axes, the rotor pins sweeping out rotor pin paths having gaps therebetween, each rotor pin being positioned to align with the rotor pin path gaps of adjacent rotors, the rotating shafts being parallel to each other, each shaft being separated from adjacent shafts by a distance substantially less than double the length of the rotor pins, whereby the rotor pins overlap and are interdigitated with the rotor pins of adjacent rotors, providing a cross-combing function;

a housing sized and shaped to contain the rotors and permit their free rotation therein, the housing having an interior surface separated from the distal ends of the rotor pins by a clearance gap, the interior surface of the housing being provided with a plurality of radially and inwardly pointing stator pins, the stator pins being substantially longer than the clearance gap, and each stator pin being positioned to reside within a gap between rotor pin paths of the adjacent rotor, the housing having an inlet for receiving pulp fibers and a single outlet through which all of the pulp fibers received through the inlet are delivered from the housing following passage of all pulp fibers across each of the rotors, and drive means for rotating the rotors.

8. The fluff generator of claim 7 including only a single inlet such that all fibers enter the housing through the single inlet.

9. The fluff generator of claim 8 wherein the rotors are arranged in a generally linear array with an inlet end rotor and an outlet end rotor comprising terminal ends of the array, and wherein the inlet is adjacent the inlet end rotor and the outlet is adjacent the outlet end rotor, such that substantially all the fiber material interacts with each of the rotors.

10. The fluff generator of claim 7 wherein the each of the rotating shafts is populated substantially along its entire length by the rotor pins.

11. A fluff generator to eliminate nits and twists from pulp fibers and to provide an output of generally separate fibers, the fluff generator comprising:

a plurality of adjacently positioned rotors, each comprising a rotating shaft having a plurality of rotor pins extending radially therefrom, the rotors all rotating in the same direction about respective rotor shaft axes, the rotor pins sweeping out rotor pin paths having gaps therebetween, each rotor pin being positioned to align with the rotor pin path gaps of adjacent rotors, the rotating shafts being parallel to each other, each shaft being separated from adjacent shafts by a distance substantially less than double the length of the rotor pins, whereby the rotor pins overlap and are interdigitated with the rotor pins of adjacent rotors, providing a cross-combing function;

a housing sized and shaped to contain the rotors and permit their free rotation therein, the housing having an interior surface separated from the distal ends of the rotor pins by a clearance gap, the interior surface of the housing being provided with a plurality of radially and inwardly pointing stator pins in conjunction with each rotor, the stator pins being substantially longer than the clearance gap, and each stator pin being positioned to reside within a gap between rotor pin paths of the adjacent rotor, the housing having an inlet for receiving pulp fibers and a single outlet through which the pulp fibers are delivered from the housing following passage across each of the rotors, and drive means for rotating the rotors.

12. The fluff generator of claim 11 including only a single inlet such that all fibers enter the housing through the single inlet.

13. The fluff generator of claim 12 wherein the rotors are arranged in a generally linear array with an inlet end rotor and an outlet end rotor comprising terminal ends of the array, and wherein the inlet is adjacent the inlet end rotor and the outlet is adjacent the outlet end rotor, such that substantially all the fiber material interacts with each of the rotors.

14. The fluff generator of claim 11 wherein the each of the rotating shafts is populated substantially along its entire length by the rotor pins.

15. The fluff generator of claim 11 wherein the housing comprises a plurality of segments, each segment conforming to a rotor and including stator pins.

* * * * *